US010380988B1

(12) United States Patent
Valeri et al.

(10) Patent No.: US 10,380,988 B1
(45) Date of Patent: Aug. 13, 2019

(54) BODY MOUNTED VEHICLE NOISE CANCELLATION SYSTEM

(71) Applicant: GM Global Technology Operations LLC, Detroit, MI (US)

(72) Inventors: Frank C. Valeri, Novi, MI (US); Scott M. Reilly, Southfield, MI (US); Eric J. Defenderfer, Brighton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/886,332

(22) Filed: Feb. 1, 2018

(51) Int. Cl.

| | |
|---|---|
| ***G10K 15/02*** | (2006.01) |
| ***G10K 11/175*** | (2006.01) |
| ***G10L 21/0208*** | (2013.01) |

(52) U.S. Cl.
CPC ..... *G10K 11/175* (2013.01); *G10K 15/02* (2013.01); *G10L 21/0208* (2013.01); *G10K 2210/1282* (2013.01); *G10K 2210/30* (2013.01)

(58) Field of Classification Search
USPC .... 381/71.4, 71.5, 71.1, 71.2, 13, 317, 73.1, 381/94.1
See application file for complete search history.

(56) References Cited

U.S. PATENT DOCUMENTS

| | | | | |
|---|---|---|---|---|
| 7,062,049 | B1 * | 6/2006 | Inoue | G10K 11/178 381/71.4 |
| 2017/0330551 | A1 * | 11/2017 | Zafeiropoulos | G10K 11/178 |
| 2018/0047383 | A1 * | 2/2018 | Hera | G10K 11/178 |

* cited by examiner

*Primary Examiner* — Yosef K Laekemariam
(74) *Attorney, Agent, or Firm* — Cantor Colburn LLP

(57) ABSTRACT

A noise cancellation system for a vehicle includes an excitation device mountable to a vehicle body component. The excitation device is operable to produce a low frequency response of the vehicle body component.

12 Claims, 3 Drawing Sheets

BODY MOUNTED VEHICLE NOISE CANCELLATION SYSTEM

INTRODUCTION

The subject disclosure relates to the art of vehicles and, more particularly, to a body mounted vehicle noise cancellation system.

Vehicles include a large number of components that are joined to one another through various fastening systems, devices, technologies and the like. In operation, parts may vibrate. Interactions between tires and a road surface or components may produce sounds that could be disruptive to passengers. In order to enhance passenger enjoyment, many vehicles include sound enhancement systems that operate to attenuate and/or mask produced sounds.

Existing sound enhancement systems typically drive sounds through vehicle mounted speakers. The sounds are designed to cancel out sounds, or at least mask sounds, produced during vehicle operation. It may be desirable to produce low frequency masking signals in certain operating conditions. Current vehicle speakers are not designed to produce low frequency sounds. Size and power constraints limit a low frequency range for existing speakers. Providing existing speakers with a low frequency noise producing capability would present various packaging challengers that would detract from vehicle desirability. Accordingly, it would be desirable to provide low frequency noise generation abilities to a vehicle without increasing size and/or power requirements of existing speakers.

SUMMARY

In accordance with an exemplary embodiment, a noise cancellation system for a vehicle includes an excitation device mountable to a vehicle body component. The excitation device is operable to produce a low frequency response of the vehicle body component.

In addition to one or more of the features described herein the excitation device is operable to produce a response below about 40 Hertz.

In addition to one or more of the features described herein the excitation device comprises an electrically operated shaker.

In addition to one or more of the features described herein the excitation device is mounted to a roof support.

In addition to one or more of the features described herein the excitation device comprises a first excitation device excitable at a first frequency at a first phase and a second excitation device excitable at the first frequency at a second phase that is distinct from the first phase.

In accordance with another aspect of an exemplary embodiment, a vehicle includes a body component and one or more body panels. A noise cancellation system including an excitation device is mounted to at least one of the vehicle body component and the one or more body panels. The excitation device is operable to produce a low frequency response of the one of the vehicle body component and the one or more body panels.

In addition to one or more of the features described herein the excitation device is operable to produce a response below about 40 Hertz.

In addition to one or more of the features described herein the excitation device comprises an electrically operated shaker.

In addition to one or more of the features described herein the one of the vehicle body component and the one or more body panels includes at least one anti-node position, the at least one excitation device being mounted at the at least one anti-node position.

In addition to one or more of the features described herein the excitation device comprises a first excitation device excitable at a first frequency at a first phase and a second excitation device excitable at the first frequency at a second phase that is distinct from the first phase.

In accordance with another aspect of an exemplary embodiment, a method of cancelling noise in a vehicle includes activating a noise cancellation system, determining that a cancellation noise is needed below a predetermined frequency threshold, and activating an excitation device to excite at least one of a vehicle body component and one or more body panels to produce a cancellation noise having a frequency below the predetermined threshold.

In addition to one or more of the features described herein determining that cancellation is needed below the predetermined frequency threshold includes determining that a cancellation noise is needed below about 40 Hertz.

In addition to one or more of the features described herein activating the excitation device includes activating an electrically operated shaker mounted to the one of the vehicle body component and the one or more body panels.

In addition to one or more of the features described herein activating the excitation device includes imparting a force to an anti-node position of the at least one vehicle body component and the one or more body panels.

In addition to one or more of the features described herein activating the excitation device includes operating a first excitation device to produce a first cancellation noise having a first frequency at a first phase and a second excitation device to produce a second cancellation noise having a second frequency at a second phase that is distinct from the first phase.

The above features and advantages, and other features and advantages of the disclosure are readily apparent from the following detailed description when taken in connection with the accompanying drawings.

BRIEF DESCRIPTION OF THE DRAWINGS

Other features, advantages and details appear, by way of example only, in the following detailed description, the detailed description referring to the drawings in which.

DETAILED DESCRIPTION

Figure 1:
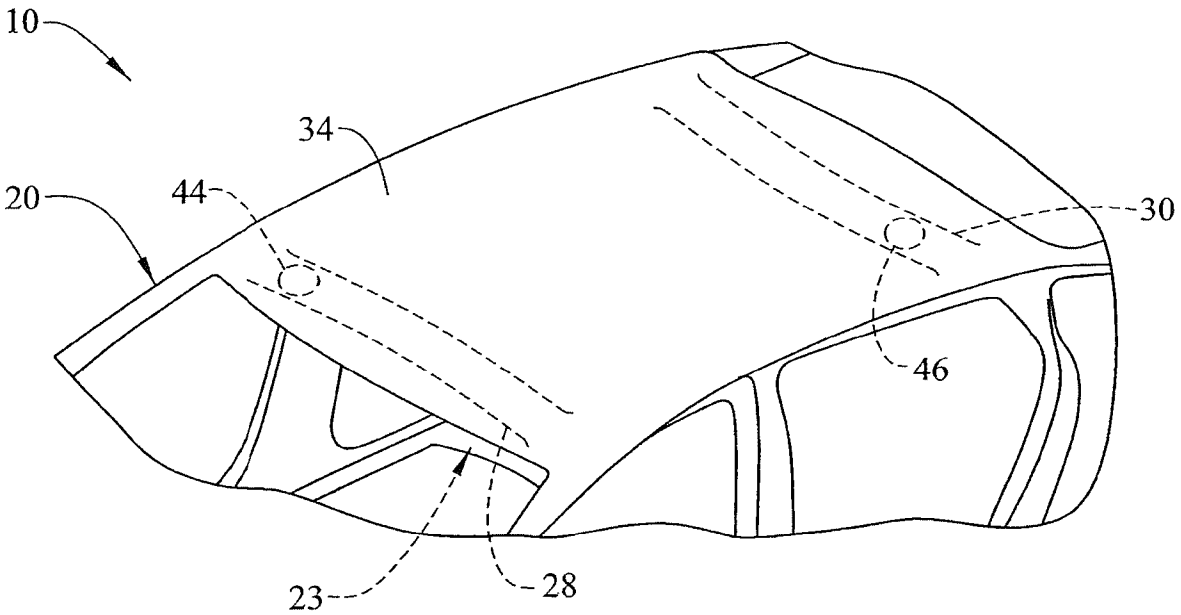
FIG. 1 depicts a vehicle including a body mounted noise cancellation system, in accordance with an aspect of an exemplary embodiment.

The following description is merely exemplary in nature and is not intended to limit the present disclosure, its application or uses. It should be understood that throughout the drawings, corresponding reference numerals indicate like or corresponding parts and features. As used herein, the term module refers to processing circuitry that may include an application specific integrated circuit (ASIC), an electronic circuit, a processor (shared, dedicated, or group) and memory that executes one or more software or firmware programs, a combinational logic circuit, and/or other suitable components that provide the described functionality.

Figure 2:
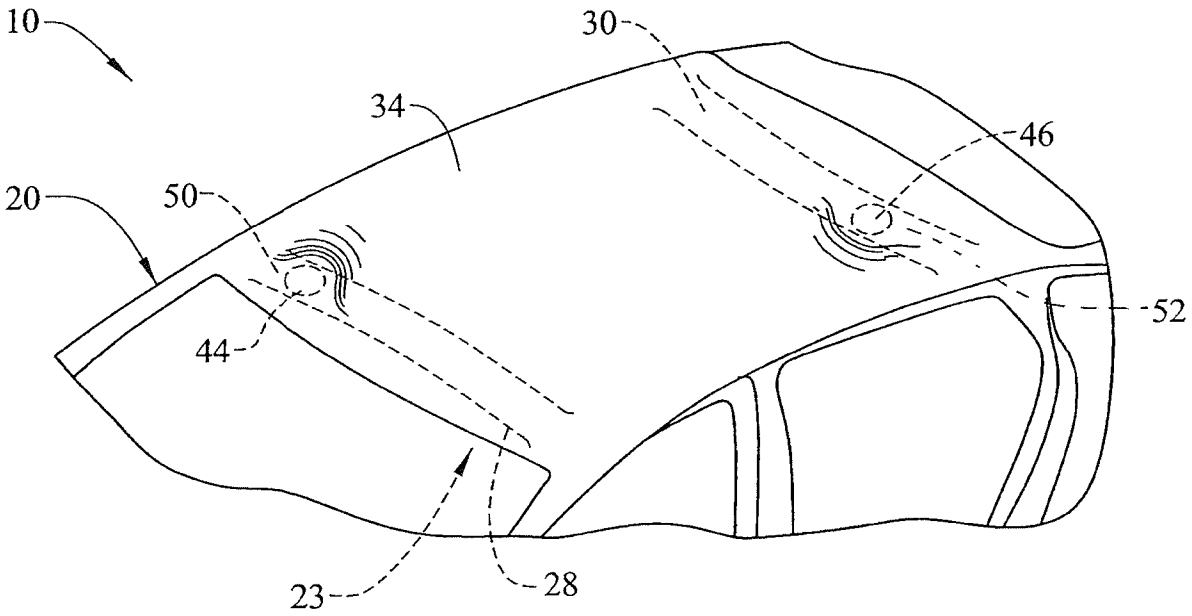
FIG. 2 depicts the body mounted noise cancellation system positioned at first and second anti-node positions of the vehicle depicted in FIG. 1, in accordance with an exemplary aspect.

A vehicle, in accordance with an aspect of an exemplary embodiment, is indicated generally at 10 in FIGS. 1 and 2. Vehicle 10 includes a body 20 having a plurality of body components 23. Body components 23 may include a first roof support 28 and a second roof support 30. First and second roof supports 28 and 30 may retain a roof panel 34. Specifically, roof panel 34 may be supported by, and connected to, first and second roof supports 28 and 30. Body components 23 may include fenders, quarter panels, floor panels, lift gates, hoods, trunk lids, door panels and the like.

In the exemplary embodiment shown, a first excitation device 44 is mounted to first roof support 28 and a second excitation device 46 is mounted to second roof support 30. The number, location, and arrangement of excitation devices may vary and could depend upon various factors such as vehicle geometry, structural characteristics of vehicle components/panels, and the like. For example, first and second excitation devices may be mounted directly to roof panel 34. Alternatively, first and second excitation devices 44 and 46 may be mounted so as to act upon a floor panel (not shown), a lift gate (also not shown) and the like. In an embodiment, first excitation device 44 may mounted to impart an excitation at a first anti-node position 50 and second excitation device 46 may be mounted so as to impart an excitation input to a second anti-node position 52 of roof panel 34. The term "anti-node position" should be understood to represent a location on roof panel 34 where excitation will provide a response having a maximum amplitude.

Figure 3:
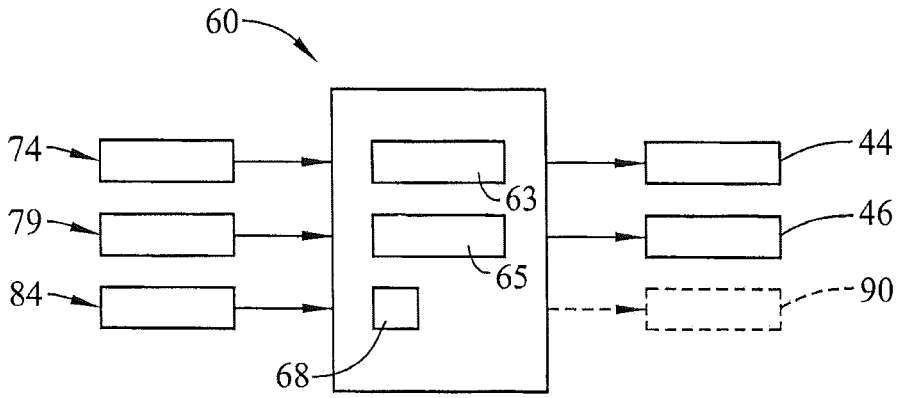
FIG. 3 depicts a block diagram illustrating the body mounted noise cancellation system, in accordance with an aspect of an exemplary embodiment.

First and second excitation devices 44 and 46 may take the form of electrically operated shakers (not separately labeled) that form part of a noise cancellation system 60 depicted in FIG. 3. The term "electrically operated shaker" should be understood to describe a tactile transducer or vibration exciter that may introduce a force into an element. In an embodiment, noise cancellation system 60 may include a central processor unit (CPU) 63, a non-volatile memory module 65 and a noise cancellation module 68. Each of CPU 63, non-volatile memory module 65 and noise cancellation module 68 may be co-located and form part of a stand-alone system or could be arranged in separate systems and operated synergistically to cancel undesirable noises in vehicle 10.

Figure 4:
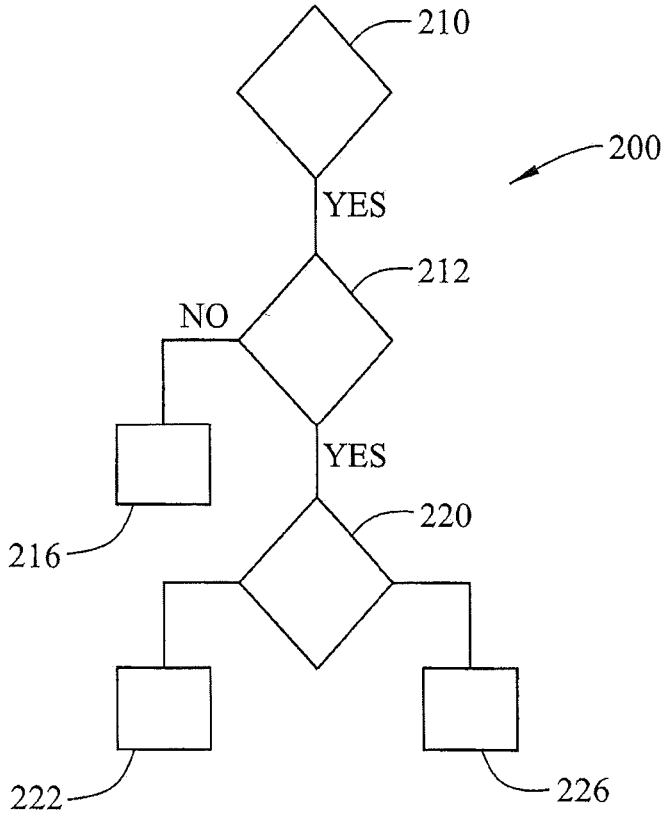
FIG. 4 depicts a flow diagram illustrating a method of cancelling vehicle noise, in accordance with an aspect of an exemplary embodiment.

In an embodiment, noise cancellation system 60 may receive inputs from microphones and/or accelerometers 74 arranged about vehicle 10, from speed and/or torque sensors 79 and/or from other vehicle based sensors 84. Noise cancellation system 60 may output a noise cancellation signal through one or more of first and second excitation devices 44 and 46 and/or other noise cancellation devices 90 such as vehicle mounted speakers. In general, as will be detailed herein, first and second excitation devices 44 and 46 are activated when a noise cancellation system 60 determines that a desired noise cancellation signal is below a threshold capable of being emitted from standard vehicle speakers. The desired noise cancellation signal may be an audible signal, such as would occur between about 20 and 20,000 Hertz. The desired noise cancellation signal may also be below the audible frequency range. In an example, the desired noise cancellation signal may be emitted to counteract sounds produced when cylinders of a multi-cylinder engine (not shown) are deactivated. Such sounds may be below about 40 Hertz or even below about 30 Hertz or lower. Such low frequency signals are not typically reproducible by standard speakers provided in a vehicle Reference will now follow to FIG. 4 in describing a method 200 of cancelling noise in vehicle 10. In block 210 a determination is made that noise cancellation is indicated. For example, signals may be received from one or more of microphones and/or accelerometers 74, speed and/or torque sensors 79 or other vehicle mounted sensors 84 indicating that noise in vehicle 10 has exceeded predetermined thresholds. In block 212, a determination is made whether a noise cancellation signal for cancelling the noise is below a predetermined threshold. For example, in block 212, the determination may be that cancellation is desired below about 40 Hertz.

If cancellation below the predetermined threshold is not indicated, vehicle based speakers 90 may be activated in block 216. If, on the other hand, cancellation would be below the predetermined threshold, a determination is made in block 220 what form of cancellation would be beneficial. Depending upon a quality of the noise to be cancelled, first and second excitation devices may be operated at a first frequency having a first phase and at a second frequency having a second phase. In block 222 the first phase may be substantially identical to the second phase. In block 226 the first phase may be distinct from the second phase. That is, first and second excitation devices may be operated in or out of phase.

At this point, it should be understood, that the exemplary embodiments describe a system for converting a vehicle body panel, which may include metal, fiberglass, and glass panels, into a speaker in order to create cancellation noises having a frequency below a predetermined threshold, such as, for example, 40 hertz. Noise cancellation may be employed to cancel out undesirable sounds associated with, for example, deactivating one or more cylinders of a multi-cylinder motor. Of course, it should be understood, that the noise cancellation system may be employed to cancel out other forms of low frequency noise.

The terms "about" and "substantially" are intended to include the degree of error associated with measurement of the particular quantity based upon the equipment available at the time of filing the application. For example, "about" and "substantially" can include a range of ±8% or 5%, or 2% of a given value.

While the above disclosure has been described with reference to exemplary embodiments, it will be understood by those skilled in the art that various changes may be made and equivalents may be substituted for elements thereof without departing from its scope. In addition, many modifications may be made to adapt a particular situation or material to the teachings of the disclosure without departing from the essential scope thereof. Therefore, it is intended that the present disclosure not be limited to the particular embodiments disclosed, but will include all embodiments falling within the scope thereof.

What is claimed is:

1. A noise cancellation system for a vehicle comprising:

a first excitation device and a second excitation device mountable to a vehicle body component, the first excitation device and the second excitation device being operable to produce a low frequency response of the vehicle body component, wherein the first excitation device is excitable at a first frequency at a first phase and the second excitation device is excitable at the first frequency at a second phase that is distinct from the first phase.

2. The noise cancellation system according to claim 1, wherein the excitation device is operable to produce a response below about 40 Hertz.

3. The noise cancellation system according to claim 1, wherein the excitation device comprises an electrically operated shaker.

4. The noise cancellation system according to claim 1, wherein the excitation device is mounted to a roof support.

5. A vehicle comprising:

a body component and one or more body panels; and a noise cancellation system including a first excitation device and a second excitation device mounted to at least one of the vehicle body component and the one or more body panels, the first excitation device and the second excitation device being operable to produce a low frequency response of the one of the vehicle body component and the one or more body panels, wherein the first excitation device is excitable at a first frequency at a first phase and the second excitation device isexcitable at the first frequency at a second phase that is distinct from the first phase.

6. The vehicle according to claim 5, wherein the excitation device is operable to produce a response below about 40 Hertz.

7. The vehicle according to claim 5, wherein the excitation device comprises an electrically operated shaker.

8. The vehicle according to claim 5, wherein the one of the vehicle body component and the one or more body panels includes at least one anti-node position, the at least one excitation device being mounted at the at least one anti-node position.

9. A method of cancelling noise in a vehicle comprising:

activating a noise cancellation system;

determining that a cancellation noise is needed below a predetermined frequency threshold; and activating a first excitation device and a second excitation device to excite at least one of a vehicle body component and one or more body panels to produce a cancellation noise having a frequency below the predetermined threshold, the first excitation device operating to produce a first cancellation noise having a first frequency at a first phase and the second excitation device operating to produce a second cancellation noise having a second frequency at a second phase that is distinct from the first phase.

10. The method of claim 9, wherein determining that cancellation is needed below the predetermined frequency threshold includes determining that a cancellation noise is needed below about 40 Hertz.

11. The method of claim 9, wherein activating the excitation device includes activating an electrically operated shaker mounted to the one of the vehicle body component and the one or more body panels.

12. The method of claim 9, wherein activating the excitation device includes imparting a force to an anti-node position of the at least one vehicle body component and the one or more body panels.

* * * * *